US007205968B2

(12) United States Patent
Choi et al.

(10) Patent No.: US 7,205,968 B2
(45) Date of Patent: Apr. 17, 2007

(54) ORGANIC ELECTROLUMINESCENCE DEVICE AND METHOD FOR FABRICATING THEREOF

(75) Inventors: Joon-Hoo Choi, Seoul (KR); Beom-Rak Choi, Seoul (KR); Chong-Chul Chai, Seoul (KR); Jin-Koo Chung, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 444 days.

(21) Appl. No.: 10/475,902

(22) PCT Filed: May 14, 2002

(86) PCT No.: PCT/KR02/00892

§ 371 (c)(1),
(2), (4) Date: Oct. 24, 2003

(87) PCT Pub. No.: WO02/093540

PCT Pub. Date: Nov. 21, 2002

(65) Prior Publication Data

US 2004/0125101 A1 Jul. 1, 2004

(30) Foreign Application Priority Data

May 14, 2001 (KR) ..... 2001-26058

(51) Int. Cl.
*G09G 3/30* (2006.01)

(52) U.S. Cl. ..... 345/77; 315/169.3

(58) Field of Classification Search ..... 345/76–79, 345/208–210; 313/504; 315/169.3
See application file for complete search history.

(56) References Cited

U.S. PATENT DOCUMENTS

| | | | | |
|---|---|---|---|---|
| 6,259,838 | B1 * | 7/2001 | Singh et al. | 385/31 |
| 6,518,962 | B2 * | 2/2003 | Kimura et al. | 345/211 |
| 6,747,617 | B1 * | 6/2004 | Kawashima | 345/76 |

FOREIGN PATENT DOCUMENTS

| | | |
|---|---|---|
| JP | 11311978 | 11/1999 |
| JP | 2001042823 | 2/2001 |
| JP | 2001143867 | 5/2001 |
| JP | 2002072947 | 3/2002 |

OTHER PUBLICATIONS

Patent Abstracts of Japan, No. 11-311978, Nov. 9, 1999.
Patent Abstracts of Japan, No. 2001-042823, Feb. 16, 2001.
Patent Abstracts of Japan, No. 2001-143867, May 25, 2001.
Patent Abstracts of Japan, No. 2002-072947, Mar. 12, 2002.

* cited by examiner

*Primary Examiner*—Amr A. Awad
*Assistant Examiner*—Steve Holton
(74) *Attorney, Agent, or Firm*—MacPherson Kwok Chan & Heid LLP

(57) ABSTRACT

There are provided an organic El device and a method of fabricating the same. Each of anode electrodes includes an organic luminescence layer disposed thereon, and a cathode electrode separately disposed on each of the organic luminescence layers. Each cathode electrode receives a power source suitable for operation properties of each of the organic luminescence layers. Accordingly, an improved image may be displayed in a full-color display.

6 Claims, 5 Drawing Sheets

ORGANIC ELECTROLUMINESCENCE DEVICE AND METHOD FOR FABRICATING THEREOF

TECHNICAL FIELD

The present invention relates to an organic EL (ElectroLuminescence) device and a method of fabricating the same, and more particularly, to an organic EL device capable of performing full-color display using a power source appropriate to operate a red, a green and a blue organic EL material that emits a red, green and blue color and a method of fabricating the same.

BACKGROUND ART

In these days, a display device for visually recognizing information processed in information processing device has been rapidly developed according as information-processing devices develop.

The display device is an interface to change data having an electrical signal format into data having an image signal format, thereby to be recognized by users. The display device may be classified into various types according to a driving method thereof.

The display device is classified into a CRT (Cathode Ray Tube) type display device having an analog driving method, an LCD (Liquid Crystal Display) device having a digital driving method and an organic EL display device that has been recently developing.

The CRT type display device has a disadvantage such as the size and weight of the CRT type display device increase in proportion to a display size of the CRT type display device. The LCD device has an advantage such as the size and weight of the LCD device do not increase although the display size of the LCD device increases. The LCD device displays images by controlling a transmissivity of a light passing through a liquid crystal.

The organic EL device displays the image by means of an organic EL material disposed between two electrodes. The organic EL material emits lights when a forward current is applied between the two electrodes like a diode.

There are weight and size differences between the LCD device and the organic EL device because of the differences of operation properties between the LCD device and the organic EL device.

Particularly, the LCD device requires a backlight assembly for increasing a uniformity of the light used to display the image. However, the organic EL device does not require a light source, such as the backlight assembly, because the organic EL material emits lights of its own accord, thereby reducing the weight and size of the display device.

FIG. 1 is a plan view showing a conventional organic EL device. FIG. 2 is a cross-sectional view cut along a line of II–II for showing a structure of the conventional organic EL device shown in FIG. 1.

Referring to FIGS. 1 and 2, the conventional organic EL device includes a transparent glass substrate 10 and TFTs 20 disposed on the transparent glass substrate 10 in a matrix configuration. The TFTs 20 are formed by a semiconductor thin film process. The TFTs 20 includes gate electrode, source electrode, drain electrode and channel layer (not shown).

The gate electrodes of TFTs arranged in a same column between the TFTs 20 in the matrix configuration are commonly connected with a gate line (not shown).

The source electrodes of TFTs arranged in a same row among the TFTs 20 in the matrix configuration are commonly connected with a data line (not shown).

The drain electrodes of the TFTs 20 in the matrix configuration are respectively connected with anode electrode 30 made of an ITO (Indium Tin Oxide) material. The anode electrode 30 supplies a hole.

A red organic EL layer 40 for emitting a light having a red wavelength, a green organic EL layer 50 for emitting a light having a green wavelength and a blue organic EL layer 60 for emitting a light having a blue wavelength is disposed on each of the anode electrodes 30, respectively.

In order to emit the red, green, and blue light, the red, green and blue organic EL layers 40, 50 and 60 require a cathode electrode 70 for supplying electrons and an anode electrode 30 for supplying holes.

The cathode electrode 70 is made of aluminum or an aluminum alloy. The cathode electrode 70 is disposed with a uniform thickness on a whole surface of the transparent glass substrate 10 to cover the red, green and blue organic EL layers 40, 50 and 60.

The cathode electrode 70 receives a cathode power source through only one external power supply line 80. The red, green and blue organic EL layers 40, 50 and 60 receive the cathode power source having a same voltage level from the cathode electrode 80.

The organic EL device may display images, moving pictures and characters, by applying a driving signal, which is appropriate to display the image, to each of the anode electrodes 30.

However, even though the same forward current is commonly applied to the red, the green and the blue organic EL layers 40, 50 and 60, it is difficult to precisely display images in a full-color and with a high resolution because brightness from the red, green and blue organic EL layers 40, 50 and 60 is different to each other.

DISCLOSURE OF THE INVENTION

Accordingly, the present invention has been devised to solve the foregoing problems of the conventional art, and it is a first object of the present invention to provide an organic EL device for displaying a full-color by controlling brightness of lights from a red, a green and a blue organic EL material that receives a constant voltage level.

It is a second object of the present invention to provide a method of fabricating an organic EL device for displaying a full-color by controlling brightness of lights from a red, a green and a blue organic EL material that receives a constant voltage level.

To accomplish the first object, there is provided an organic EL device comprising: a plurality of anode electrodes for receiving an anode power source having a predetermined level corresponding to an image data, the anode power source being selectively supplied to the anode electrodes by mean of a TFT; a plurality of organic luminescence layers disposed on each of the anode electrodes; and a plurality of cathode electrodes disposed on each of the organic luminescence layers, each of the cathode electrode receiving a different cathode power source depending on luminescence characteristics of the organic luminescence layers.

To accomplish the second object, there is provided a method of fabricating an organic EL device, comprising: forming a plurality of anode electrodes for receiving an anode power source having a predetermined level corresponding to an image data, the anode power source being selectively supplied to the anode electrodes by mean of a TFT; forming a red organic luminescence layer, a green organic luminescence layer and a blue organic luminescence layer, respectively, on each of the anode electrodes; forming a first cathode electrode, a second cathode electrode and a third cathode electrode on the red, green and blue organic luminescence layers, respectively; and forming a power supply line on each of the first, second and third cathode electrodes to supply a different cathode power source to each of the red, green and blue organic electroluminescence layers.

BRIEF DESCRIPTION OF THE DRAWINGS

The above objects and other advantages of the present invention will become more apparently by describing in detail the preferred embodiments thereof with reference to the accompanying drawings, in which.

BEST MODE FOR CARRYING OUT THE INVENTION

Hereinafter, preferred embodiments are described with reference to the accompanying drawings.

Figure 1:
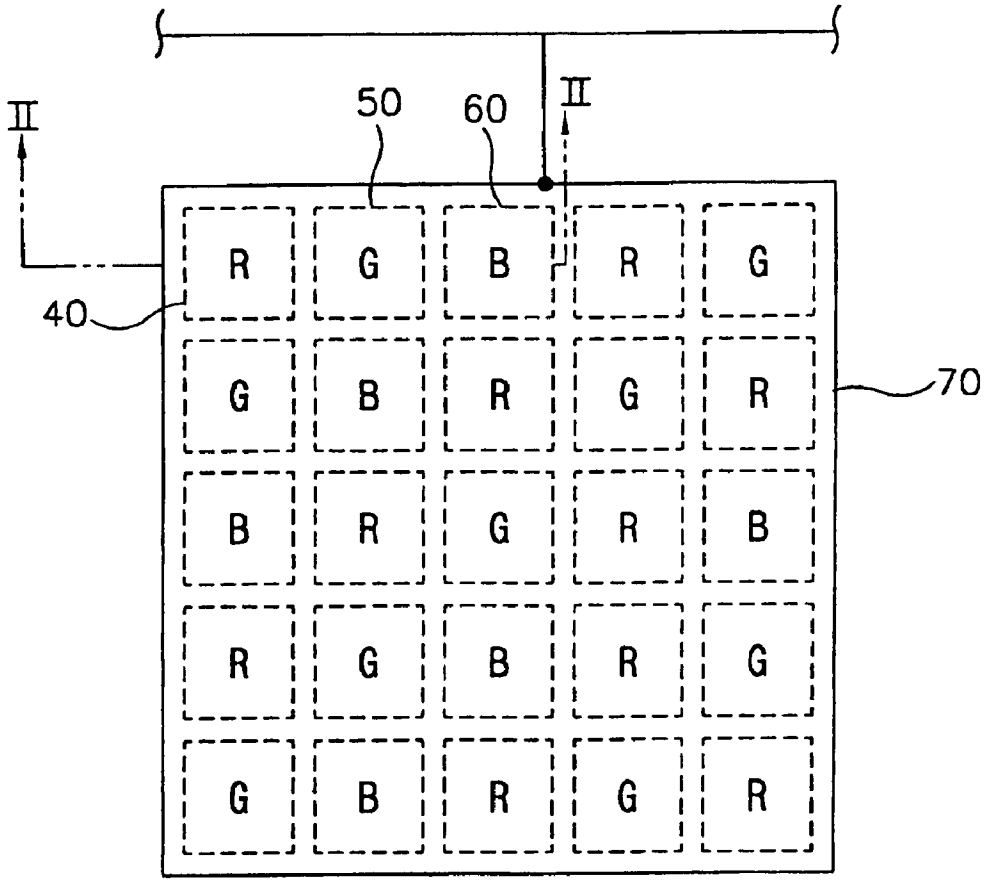
FIG. 1 (PRIOR ART)
FIG. 1 is a plan view showing a conventional organic EL device.
Figure 2:
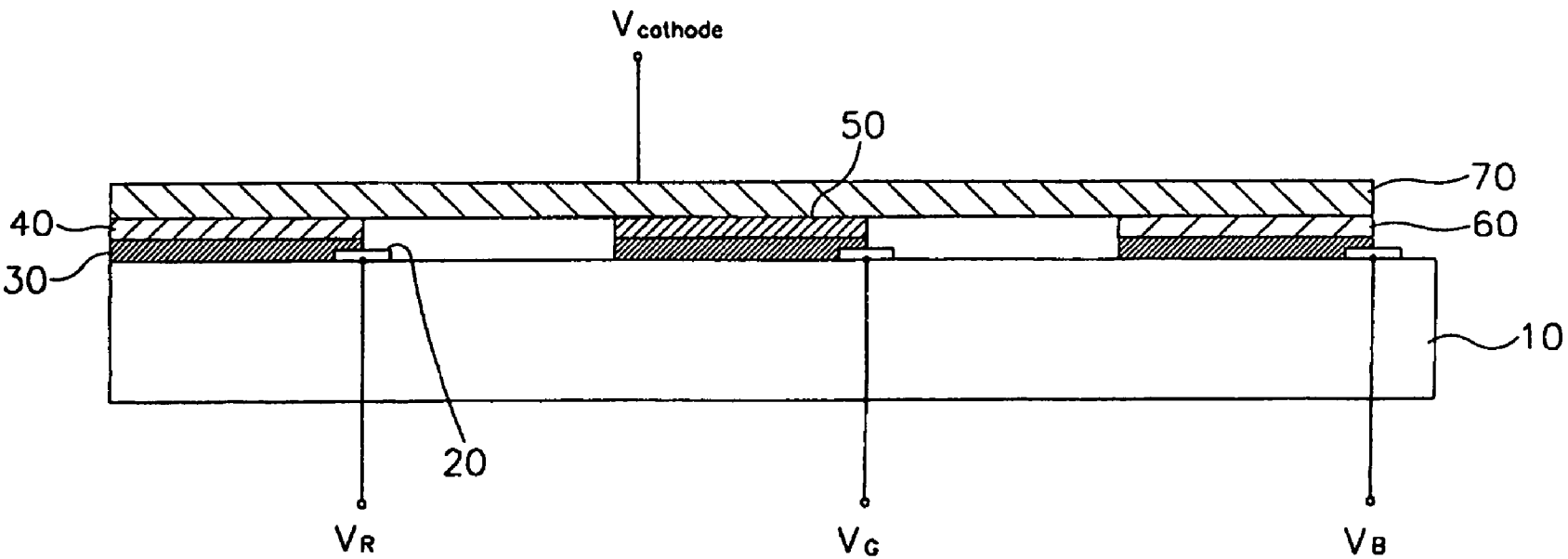
FIG. 2 (PRIOR ART)
FIG. 2 is a cross-sectional view cut along a line of II—II for showing a structure of the conventional organic EL device shown in FIG. 1.
Figure 3:
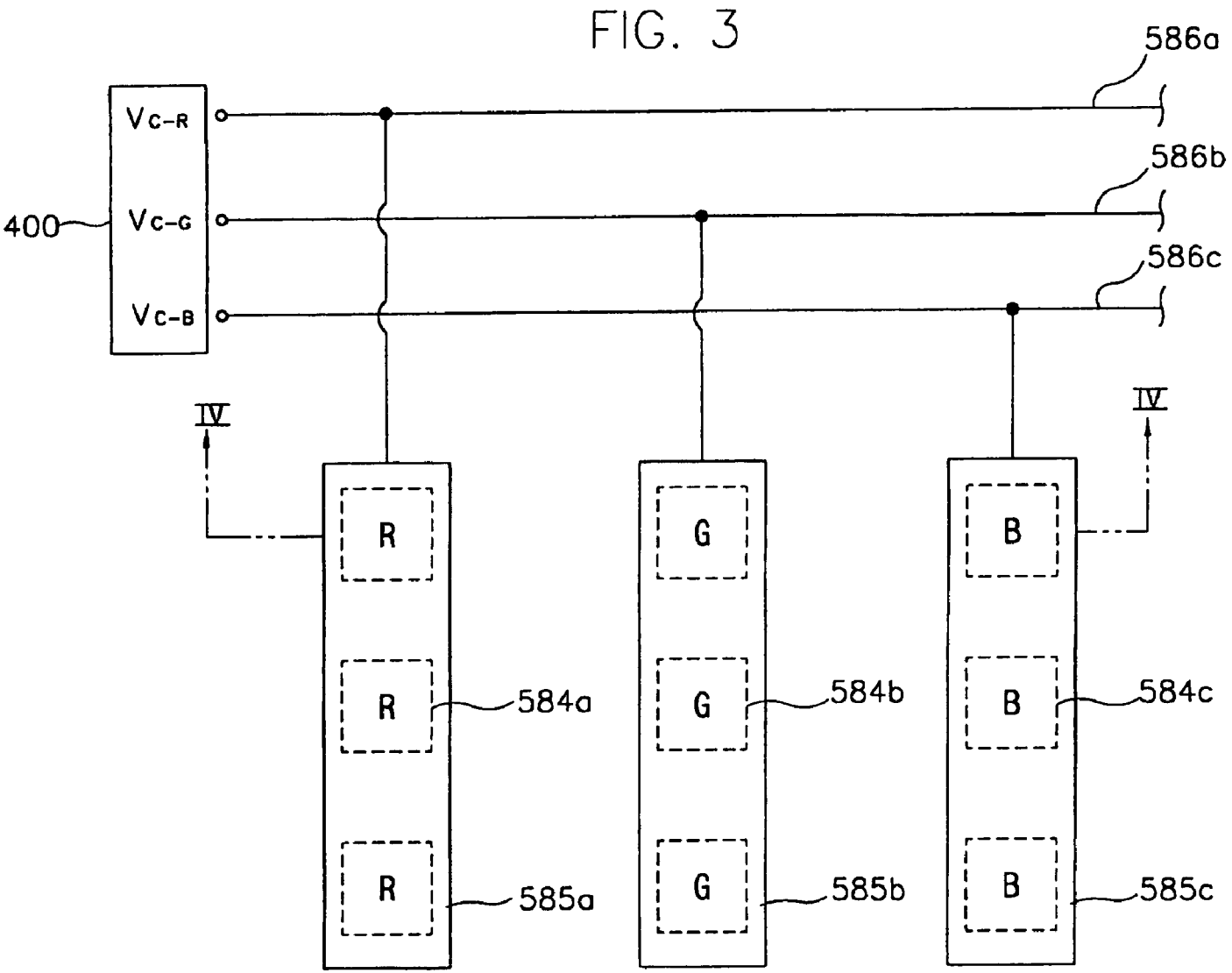
FIG. 3 is a plan view showing an organic EL device according to one preferred embodiment of the present invention.
Figure 4:
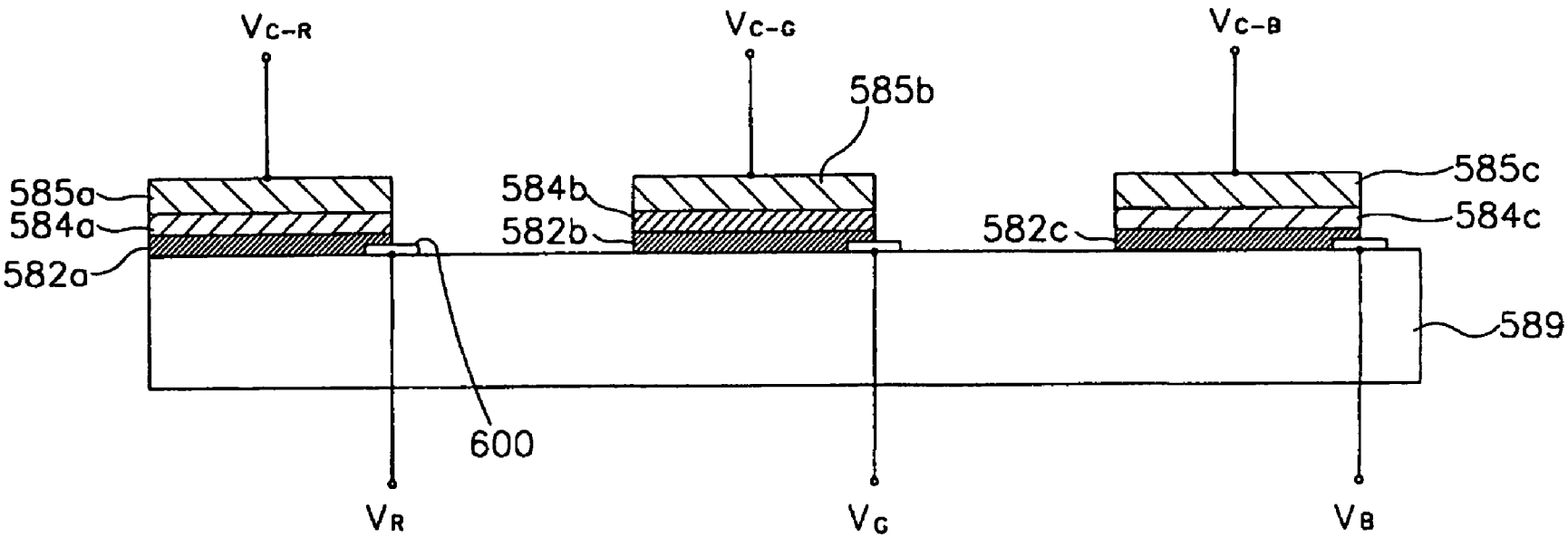
FIG. 4 is a cross-sectional view cut along a line of IV—IV for showing a structure of the organic EL device shown in FIG. 3.
Figure 5:
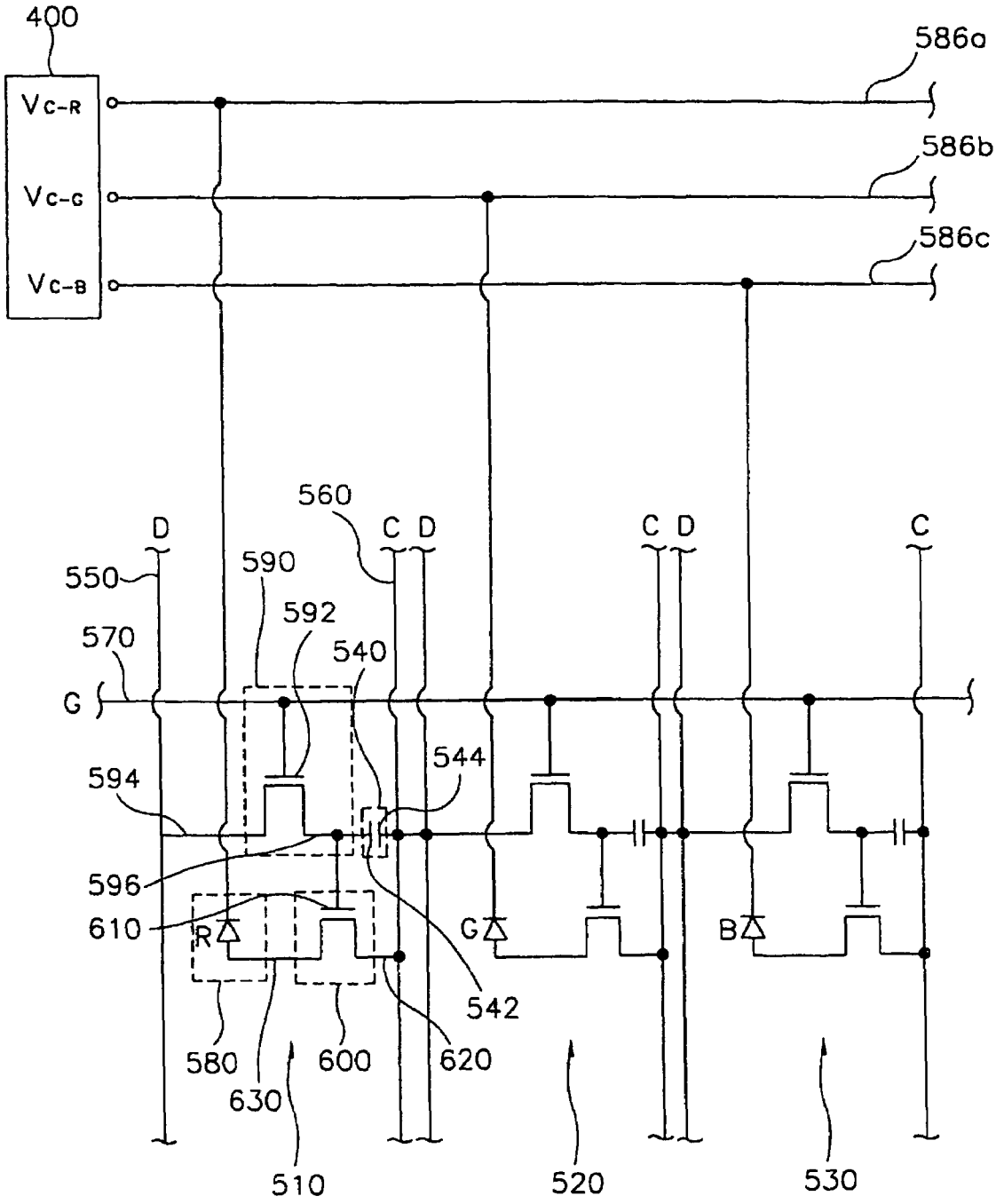
FIG. 5 is a circuit diagram showing the organic EL device according to one preferred embodiment of the present invention.

FIG. 3 is a plan view showing an organic EL device according to the present invention. FIG. 4 is a cross-sectional view cut along a line of IV—IV for showing a structure of the organic EL device shown in FIG. 3. FIG. 5 is a circuit diagram showing the organic EL device according to the present invention.

Referring to FIG. 5, an organic EL device 500 includes a plurality of organic EL elements 510, 520 and 530. In the present embodiment, three organic EL elements will be described.

Each of the organic EL elements 510, 520, 530 includes driving signal lines 550, 560 and 570, two TFTs 590 and 600, an image maintaining capacitor 540 and a pixel 580.

The driving signal line referred to as a reference numeral 550 indicates a data line, the driving signal line referred to as a reference numeral 560 indicates a bias line, and the driving signal line referred to as a reference numeral 570 indicates a gate line.

One of the TFTs 590 and 600 indicates a switching transistor 590 and the other of the TFTs 590 and 600 indicates a driving transistor 600.

The switching transistor 590 includes a gate electrode 592, a source electrode 594 and a drain electrode 596.

The gate electrode 592 of the switching transistor 590 is connected with the gate line 570. The gate line 570 receives a threshold voltage enough to turn on the switching transistor 590. The source electrode 594 of the switching transistor 590 is connected with the data line 550. The drain electrode 596 of the switching transistor 590 is connected with the driving transistor 596 and simultaneously the image maintaining capacitor 540.

The image maintaining capacitor 540 includes a first electrode 542, a dielectric and a second electrode 544. The first electrode 542 is connected with the drain electrode 596 of the switching transistor 590 and the second electrode 544 is connected with the bias line 560.

The driving transistor 600 includes a gate electrode 610, a source electrode 620 and a drain electrode 630. The gate electrode 610 of the driving transistor 600 is connected with the drain electrode 596 of the switching transistor 590. The source electrode 620 of the driving transistor 600 is connected with the bias line 560. The drain electrode 630 of the driving transistor 600 is connected with the pixel 580.

The data line 550 receives a power source having a predetermined voltage sequentially. The switching transistor 590 connected with the gate lines 570 is turned on by applying a power source to the switching transistor 590 for a short period. The power source applied to the data line 550 is provided to the drain electrode 596 of the switching transistor 590 through the source electrode 594 and the channel layer (not shown) thereof.

The power source provided to the drain electrode 596 of the switching transistor 590 is output through two paths.

Particularly, some portion of the power source provided to the drain electrode 596 of the switching transistor 590 is supplied to the first electrode 542 of the image maintaining capacitor 540. The image maintaining capacitor 540 is charged because the power source is always applied to the second electrode 544 through the bias line 560.

Other portion of the power source provided to the drain electrode 596 of the switching transistor 590 is supplied to the gate electrode 610 of the driving transistor 600. The power source applied to the bias line 560 is output to the drain electrode 630 of the driving transistor 600 through the source electrode 620 and the channel layer thereof.

The power source output to the drain electrode 630 of the driving transistor 600 is applied to the pixel 580.

The switching transistor 590 supplies the power source to the gate electrode 610 of the driving transistor 600 only when the power source is applied to the gate line 570.

Accordingly, when the switching transistor 590 is turned off, the image maintaining capacitor 540 discharges. The driving transistor 600 maintains turn-on status by the discharge voltage of the image maintaining capacitor 540 for a. predetermined period (a period for which a frame of the image is maintained).

The power source output from the drain electrode 630 of the driving transistor 600 is applied to the pixel 580 during a discharging time of the image maintaining capacitor 540.

Referring to FIGS. 3 and 4, the pixel 580 includes a transparent conductive anode electrode 582 connected with drain electrode 630 of the driving transistor 600, organic luminescence layers 584*a*, 584*b* and 584*c* and cathode electrodes 585*a*, 585*b* and 585*c*.

The anode electrode 582 is connected with the driving transistor 600, and arranged in a matrix configuration.

Each of the organic luminescence layers 584*a*, 584*b* and 584*c* is disposed on the anode electrode 582 arranged in the matrix configuration. Particularly, the same kind of organic luminescence layer among the organic luminescence layers 584*a*, 584*b* and 584*c* is arranged in each column of the anode electrode 582.

Reference numerals 584*a*, 584*b* and 584*c* indicate a red organic luminescence layer, a green organic luminescence layer and a blue organic luminescence layer, respectively.

Referring to FIG. 3, the red organic luminescence layer 584*a* is disposed on the anode electrode 582 in a first column, thereby the red organic luminescence layer 584*a* to constitute a red organic luminescence group.

The green organic luminescence layer 584*b* is disposed on the anode electrode 582 in a second column, thereby the green organic luminescence layer 584*b* to constitute a green organic luminescence group.

The blue organic luminescence layer 584*c* is disposed on the anode electrode 582 in a third row, thereby the blue organic luminescence layer 584*c* to constitute a blue organic luminescence group.

In order to form cathode electrodes 585*a*, 585*b* and 585*c* to be insulated and not to be electrically short each other, the red, green and blue organic luminescence groups are separated each other by the column.

Particularly, as shown in FIGS. 3 and 4, a cathode electrode 585*a* for red organic luminescence group, a cathode electrode 585*b* for green organic luminescence group and a cathode electrode 585*c* for blue organic luminescence group is formed by a semiconductor thin film technology not to be electrically short each other.

The cathode electrode 585*a* for the red organic luminescence group receives a voltage $V_{C-R}$ that is optimized for the red organic luminescence material. The cathode electrode 585*b* for the green organic luminescence group receives a voltage $V_{C-G}$ that is optimized for the green organic luminescence material. The cathode electrode 585*c* for the blue organic luminescence group receives a voltage $V_{C-B}$ that is optimized for the blue organic luminescence material.

The voltage $V_{C-R}$, the voltage $V_{C-G}$ and the voltage $V_{C-B}$ are applied through the power supply lines 586*a*, 586*b* and 586*c*, respectively. The voltage $V_{C-R}$, the voltage $V_{C-G}$ and the voltage $V_{C-B}$ are provided by means of a power supply controller 400. The power supply controller 400 provides the voltage that is obtained based on a simulated result with respect to characteristics of the red, green and blue organic luminescence materials.

Hereinafter, a method for displaying the image by means of the organic EL device will be described with reference to FIGS. 3 to 5.

The data line 550 receives a predetermined power source. The gate line 570 receives a power source having a voltage level higher than the threshold voltage of the switching transistor 590. Thus, the power source applied to the data line 550 is applied to the drain electrode 596 of the switching transistor 590 through the source electrode 594 and the channel layer thereof.

Next, the power source output from the drain electrode 596 of the switching transistor 590 charges the image maintaining capacitor 540, and simultaneously applies a power source having a voltage level higher than the threshold voltage of the driving transistor 600 to the gate electrode 610 of the driving transistor 600.

The power source having the voltage level higher than the threshold voltage of the switching transistor 590 is applied to the gate line 570 for a very short period. When the supply of the power source to the drain electrode 596 of the switching transistor 590 is stopped, electric charges charged at the image maintaining capacitor 540 is discharged.

Accordingly, the power source charged at the image maintaining capacitor 540 is applied as a turn on voltage to the gate electrode 610 of the driving transistor 600 for a period corresponding to a frame. As a result, the anode electrode 582 receives a predetermined current from the bias line 560 for the discharge period of the image maintaining capacitor 540.

The cathode electrode 585*a* for the red organic luminescence group, the cathode electrode 585*b* for the green organic luminescence group and the cathode electrode 585*c* for the blue organic luminescence group receive the optimized voltage $V_{C-R}$, $V_{C-G}$ and $V_{C-B}$, respectively, generated from the power supply controller 400 through an external terminal.

Thus, the cathode electrode 585*a* for the red organic luminescence group, the cathode electrode 585*b* for the green organic luminescence group and the cathode electrode 585*c* for the blue organic luminescence group supplies electrons to the red, the green and the blue organic luminescence layers 584*a*, 584*b* and 584*c*, respectively.

Also, since the anode electrode 583 continuously provides holes, the electrons and the holes bond each other in the red, the green and the blue organic luminescence layers 584*a*, 584*b* and 584*c*, and an energy level change is caused by the bonding between electrons and holes.

Therefore, the light having the red wavelength, the light having the green wavelength and the light having the blue wavelength are emitted based on properties of the red, green and blue organic luminescence layers 584*a*, 584*b* and 584*c*. When a power source having a same voltage level is supplied from the anode electrode 582, the red, green and blue organic luminescence layers 584*a*, 584*b* and 584*c* receive, lights having similar brightness each other is generated even though there is differences of properties between the red, green and blue organic luminescence layers 584*a*, 584*b* and 584*c*. This is because the cathode electrodes 585*a*, 585*b* and 585*c* compensate the brightness differences between the red, green and the blue organic luminescence layers 584*a*, 584*b* and 584*c*.

The light having the red wavelength, the light having the green wavelength and the light having the blue wavelength pass through the anode electrode 582 and the glass substrate 589, and are provided into the user's eyes, thereby displaying a required images.

INDUSTRIAL APPLICABILITY

As described previously, a power source that is optimized for each of the red, green and blue organic luminescence layers is applied to the each cathode electrodes for the red, green and blue organic luminescence groups separated from each other, respectively. Accordingly, the organic EL device can display an improved image.

This invention has been described above with reference to the aforementioned embodiments. It is evident, however, that many alternative modifications and variations will be apparent to those having skills in the art in light of the foregoing description. Accordingly, the present invention embraces all such alternative modifications and variations as fall within the spirit and scope of the appended claims.

The invention claimed is:

1. An organic electro luminescence device comprising:

a plurality of anode electrodes to receive an anode power having a predetermined level corresponding to associated image data, the anode power being selectively supplied to each of the anode electrodes by an associated thin film transistor;

an associated organic luminescence region comprising an organic luminescence layer material type disposed on each of the anode electrodes;

a plurality of cathode electrodes, each of the plurality of cathode electrodes associated with a plurality of organic luminescence regions having a particular luminescence layer material type, each of the cathode electrodes to receive a cathode power based on the associated organic luminescence layer material type;

wherein the plurality of anode electrodes are arranged in a matrix configuration, and wherein the associated organic luminescence layer material type for each of the plurality of anode electrodes is selected from the group consisting of red, green and blue organic luminescent material; and wherein a first cathode electrode is associated with a plurality of organic luminescence regions having red luminescent material, a second cathode electrode is associated with a plurality of organic luminescence regions having green luminescent material, and a third cathode electrode is associated with a plurality of organic luminescence regions having blue luminescent material, and wherein the first cathode electrode, the second cathode electrode, and the third cathode electrode are separate from one another.

2. The organic electro luminescence device of claim 1, wherein a plurality of anode electrodes in a first column of the matrix configuration are associated with organic luminescence regions having red organic luminescence material, a plurality of anode electrodes in a second column of the matrix configuration are associated with organic luminescence regions having green organic luminescence material, and a plurality of anode electrodes in a third column of the matrix configuration are associated with organic luminescence regions having blue organic luminescence material.

3. The organic electro luminescence device of claim 2, wherein the first cathode electrode is in electrical communication with the organic luminescence regions having red organic luminescence material and disposed opposite the anode electrodes in the first column, the second cathode electrode is in electrical communication with the organic luminescence regions having green organic luminescence material and disposed opposite the anode electrodes in the second column, and the third cathode electrode is in electrical communication with the organic luminescence regions having blue organic luminescence material and disposed opposite the anode electrodes in the third column.

4. The organic electro luminescence device of claim 3, wherein the first, the second and the third cathode electrodes are in communication with a power supply controller configured to supply a different power amount depending on luminescence characteristics of the red, green and blue organic luminescence material.

5. A method of fabricating an organic electro luminescence device, comprising:

forming a plurality of anode electrodes to receive an anode power having a predetermined level corresponding to image data, the anode power being selectively supplied to each of the plurality of anode electrodes using an associated thin film transistor;

forming an organic luminescence layer having a luminescence material selected from the group consisting of a red organic luminescence material, a green organic luminescence material and a blue organic luminescence material on each of the anode electrodes;

forming a first cathode electrode on a plurality of organic luminescence layers having red organic luminescence material, a second cathode electrode on a plurality of organic luminescence layers having green organic luminescence material, and a third cathode electrode on a plurality of organic luminescence layers having blue organic luminescence material; and forming a power supply line in communication with each of the first, second and third cathode electrodes, the power supply line to supply a different cathode power to each of the red, green and blue organic electroluminescence layers.

6. An organic electro luminescence device comprising:

a plurality of anode electrodes to receive an anode power having a predetermined level corresponding to associated image data, the anode power being selectively supplied to each of the anode electrodes by an associated thin film transistor;

an associated organic luminescence region comprising an organic luminescence layer material type disposed on each of the anode electrodes; and a plurality of cathode electrodes, each of the plurality of cathode electrodes associated with a plurality of organic luminescence regions having a particular luminescence layer material type, each of the cathode electrodes to receive a cathode power based on the associated organic luminescence layer material type; and wherein a first cathode electrode is in communication with a plurality of organic luminescence regions having a first luminescence layer material type, wherein a second cathode electrode is in communication with a plurality of organic luminescence regions having a second different luminescence layer material type, and wherein the device is configured to provide cathode power to the first cathode electrode and the second cathode electrode to generate light with substantially similar brightness for a substantially similar predetermined level of the anode power.

* * * * *